United States Patent [19]

Doggett et al.

[11] 3,935,498

[45] Jan. 27, 1976

[54] ELECTRON GUN ASSEMBLY

[75] Inventors: Frederick F. Doggett, East Syracuse; Leonard W. Jenne, Jr., Baldwinsville, both of N.Y.

[73] Assignee: General Electric Company, Portsmouth, Va.

[22] Filed: Feb. 14, 1973

[21] Appl. No.: 332,338

Related U.S. Application Data

[63] Continuation of Ser. No. 731,807, May 24, 1968, abandoned.

[52] U.S. Cl. ..... 313/417

[51] Int. Cl. ..... H01j 29/02; H01j 29/50

[58] Field of Search .. 313/69 C, 70 C, 92 B, 82 BF, 313/82 R

[56] References Cited

UNITED STATES PATENTS

| | | | |
|---|---|---|---|
| 2,170,944 | 8/1939 | Glass et al. | 313/82 R X |
| 2,859,378 | 11/1958 | Gundert et al. | 313/70 C X |
| 3,268,753 | 8/1966 | Hughest | 313/69 C |

OTHER PUBLICATIONS

GE, Electronics World cover page for March, 1966.

*Primary Examiner*—Robert Segal

[57] ABSTRACT

An electron gun assembly of the three gun, in-line type. The three guns each including a plurality of electrode elements are rigidly attached to four support rods or glass beads by a mounting means comprising four metal straps which connect each of the outer gun elements to two support rods and the center gun elements to all four support rods. A first group of four L-shaped metal tabs are imbedded in the ends of the support rods, and two mounting bars are each connected at both ends to two of the tabs for the purpose of making electrical connections to the gun heater elements. A second group of "U"-shaped metal tabs are also imbedded in the ends of the support rods to permit a mechanical connection of a stem component whereby the gun electrode elements are isolated from forces applied to the stem. A convergence assembly is self-registering with respect to the gun assembly by the alignment of precision holes in the base of the convergence assembly with cut-outs provided in a flange on the center gun electrode. A plurality of slots are provided in the wall of the convergence assembly which permit self-registering of pole piece elements positioned inside the assembly.

7 Claims, 6 Drawing Figures

ELECTRON GUN ASSEMBLY

This is a continuation of application Ser. No. 731,807, filed May 24, 1968, now abandoned.

BACKGROUND OF THE INVENTION

This invention relates to electron gun assemblies and, more particularly, to three gun assemblies for color television picture tubes.

Electron gun assemblies to which this invention relates comprise, generally, a battery of three guns, a pole piece convergence assembly, and a glass stem provided with rigid metal prongs or leads. Each of the guns includes a plurality of electrode elements, usually cylindrically shaped, and positioned along a common axis. Electron guns may be placed in two categories, delta and in-line, depending upon the orientation of the three guns. The in-line type of gun, to which this invention relates, may be defined as the type wherein the longitudinal axes of the three guns lie in the same plane. With this type of gun the three dots produced thereby appear on the cathode ray tube screen in a line as opposed to a triad as is the case with the delta gun.

A precise degree of alignment accuracy is required with respect to the supporting arrangement for the three guns as well as to the connection of the stem to the gun assembly and the convergence assembly to the guns. As higher resolution is required in cathode ray tubes, the size of the phosphor dot in the screen must be smaller. The number of dots must also be increased. This smaller dot size, in turn, requires better landing accuracy of the electron spot which provides a lower tolerance for errors caused by poor electron gun alignment. Therefore, with poor alignment the beam may be displaced too far from its desired point of landing on the screen. Errors in the linear direction of the outside beams, that is, may be compensated for by means of the pole pieces in the convergence assembly. Errors in the center beam are compensated for by a purity magnet. Rotational errors, on the other hand, in the in-line tube, cannot be compensated for. Thus, if the entire gun assembly is rotated, the line on the screen in which the three spots appear would be canted in relation to the axes of the tube which is not tolerable.

The causes of poor alignment arise at various parts in the entire gun assembly. The battery of electron guns is usually mounted to support rods, commonly made of an electrically insulating material such as glass and designated as beads. In the in-line type of gun, the need for a rigid mounting structure is critical because the two outer guns are referenced to the center gun and there is no control over the center gun beam through the convergence assembly. With prior art mounting arrangements, the guns often move out of alignment during the manufacture and assembly of the rest of the structure. The connection of the stem to the gun assembly is also a source of alignment problems. In the prior art arrangements, the leads or prongs on the stems have been attached to the gun elements, and a force applied on the stem will necessarily be applied to the gun elements and can move them out of alignment. Moreover, in these designs the heaters and cathodes of the gun elements are connected directly to the stem and it was thus necessary to put the stem on first. The cathode and heater elements were thus difficult to get at during assembly, the structure could be moved out of alignment in trying to do so, and automated assembly was thus virtually impossible.

The registering of the pole piece convergence assembly to the rest of the gun assembly has also been a source of misalignment. Arrangements designed heretofore for mating the convergence assembly to the gun assembly have required some sort of fitting-in of one part to another as, for example, where detents are put in the base element of the convergence assembly. With the in-line arrangement an even more accurate alignment is needed and it would be desirable to have a self-registering alignment scheme to provide maximum protection against rotational errors. Finally, the assembling of the pole piece elements within the convergence assembly must be done accurately, and this is especially critical in the in-line type gun because, in order to get the proper raster size, the center gun must be magnetically isolated. Again, a self-registering arrangement would be most desirable.

SUMMARY OF THE INVENTION

It is therefore an object of this invention to provide an electron gun assembly of the in-line type having an extremely rigid structure that will maintain alignment of the various components of the assembly so that the gun will provide the desired performance when used in cathode ray tubes which require extremely high resolution and hence small spot size.

It is a further object of this invention to provide a three electron gun structure of the in-line type which is readily adaptable to automated manufacturing techniques.

It is a more particular object of this invention to provide an in-line type of electron gun assembly having an integral and rigid supporting structure between the gun elements and the supporting rods or beads. In addition, accurate alignment reference points of the convergence assembly and stem to the integral beaded gun structure are provided.

It is a further object of this invention to provide an electron gun assembly of the in-line type wherein the stem component is connected to the assembly of gun elements and beads such that the gun elements are isolated from any force applied to the stem component.

It is a further object of this invention to provide such a gun assembly wherein the electrical connections and adjustments of the "dress" of the electrical leads for the cathode and heater elements on the guns can be made before the stem component is assembled thereto.

It is a further object of this invention to provide such an electron gun assembly wherein the mechanical connection between the pole piece convergence assembly and the gun assembly is self-registering.

It is a further object of this invention to provide a self-registering alignment scheme for the pole pieces which are assembled within the convergence assembly.

It is yet another object of this invention to provide a plural gun assembly that is conveniently adapted to automated assembly procedures.

In carrying out this invention in one form there is provided an integral truss-type supporting structure between the electron gun electrode elements and the supporting rods or beads whereby each of the electrodes is independently supported and the center gun is attached to all four supporting rods or beads. The heater and cathode electrical connections are suspended from the gun and bead assembly to enable connection before the stem component is attached thereto. The stem component is mounted directly to the supporting rods or beads such that the electron gun electrode elements are isolated from any forces applied to the stem component. A self-registering alignment is effected between the electron gun and bead assembly and the pole piece convergence assembly in such a manner as to prevent rotational errors. Slots are provided in the convergence assembly and are utilized in a manner so as to provide a self-registering alignment scheme for the pole piece elements which are positioned therein.

DETAILED DESCRIPTION

This invention is recited in the appended claims. A more thorough understanding of the additional advantages and further objects of this invention may be obtained by referring to the following description taken in conjunction with the accompanying drawings wherein:

Figure 1:
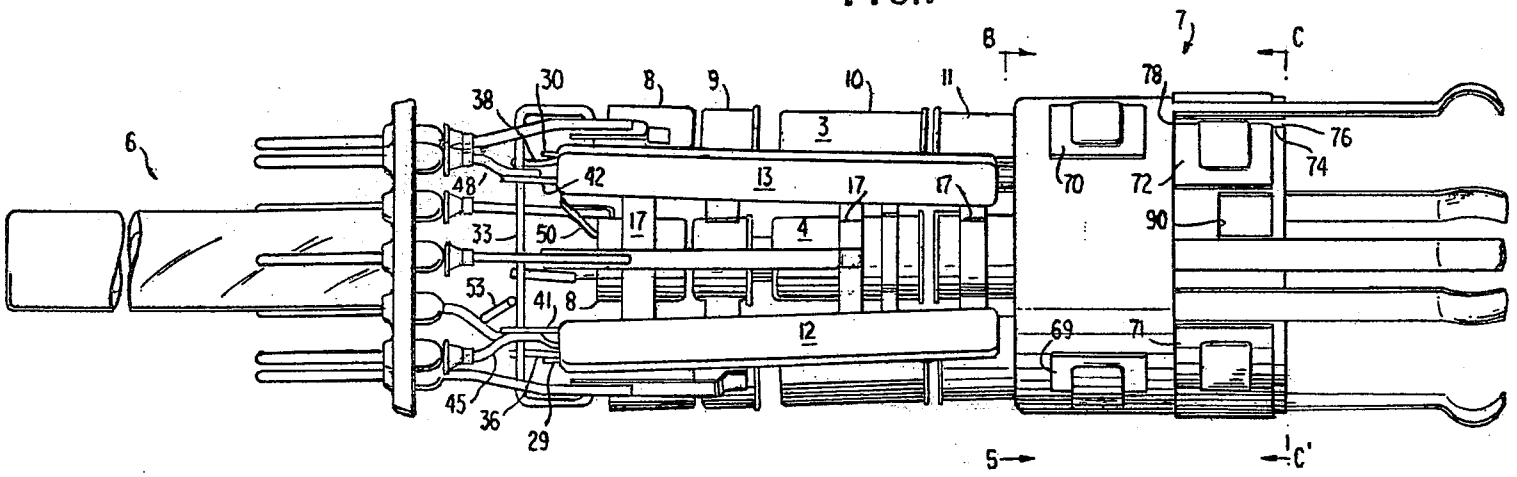
FIG. 1 is a top view of an in-line electron gun assembly constructed in accordance with this invention.
Figure 2:
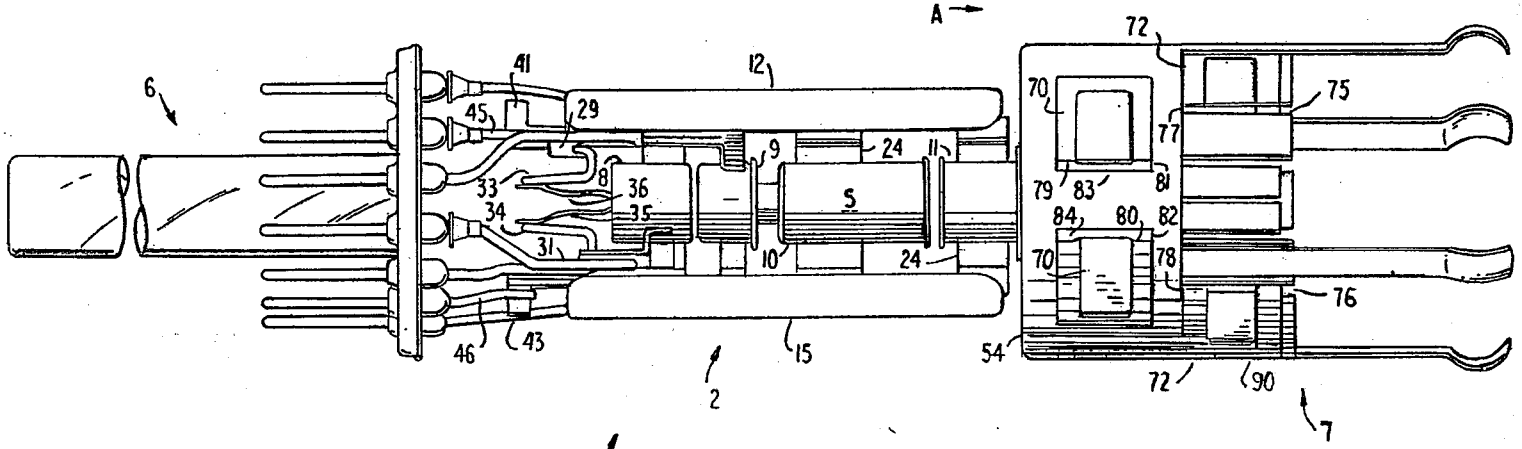
FIG. 2 is a side view of the electron gun assembly shown in FIG. 1.

The electron gun assembly constructed in accordance with this invention is shown in the top view and side views of FIG. 1 and FIG. 2, respectively. The entire assembly 1 may be divided for purposes of explanation into three main parts, a battery 2 of three electron guns, 3, 4, and 5, a stem 6, and a pole piece convergence assembly 7. The three electron guns which comprise the battery are arranged in an in-line configuration, that is, arranged so that the longitudinal axes of the guns lie in the same plane. The gun 4 may be designated the center gun and the guns 0, 5 the two outer guns. Each of the three guns in this particular illustration includes four electrode elements. Referring to the outer gun 3 shown in FIG. 1, there is a control grid 8, commonly called the G-1 grid, an accelerating (G-2) grid 9, a focus control (G-3) grid 10, and a second accelerating (G-4) grid 11. Each of the guns 4 and 5 have identical elements. The cathode and heater assemblies are mounted in the control grid 8, and the structure for providing electrical connections to them will be described further on in the specification. The accelerating grid electrode 11 of each gun is connected to and registered with the convergence assembly in a manner which will be described further on in the specification.

Figure 3:
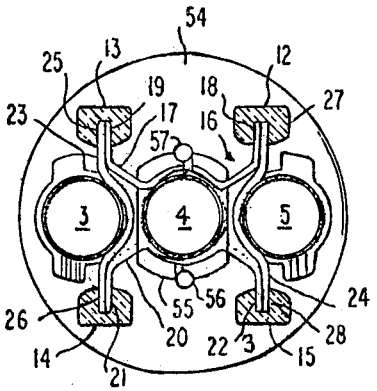
FIG. 3 is a cross sectional view taken along the lines A-A′ in FIG. 2.

In accordance with one aspect of this invention there is provided an arrangement for mounting together the three electron guns and hence the electrode elements thereof. Four support rods 12–15 made of an electrically insulating material such as glass and commonly known in the art as beads are positioned around the three guns in a spaced relationship. This may be easily seen in the sectional view of FIG. 3. A mounting means 16 for connecting each gun element to two of the support rods constitutes an integral truss-type supporting structure. The mounting means comprises a first strap 17 rigidly attached, for example by spot welding, to the electrodes of the center gun 4 and having corresponding ends 18, 19 secured to the support rods 12, 13. The ends 18, 19 are secured in this particular illustration by being imbedded in the glass beads 12, 13. The mounting means 16 also includes a second strap 20 rigidly attached to the center gun 4 and having corresponding ends 21, 22 imbedded in the support rods or beads 14, 15. Third and fourth straps 23 and 24, respectively, are also provided, the third strap 23 being rigidly attached to the outer gun 3 and having corresponding ends 25 and 26 imbedded in the glass beads 13 and 14, respectively, and the fourth strap 24 being rigidly attached to the other outer gun 5 and having corresponding ends 27 and 28 imbedded in the glass beads 12 and 15, respectively. The ends of all the straps are imbedded in the glass beads in a manner so as to be electrically isolated from each other. The beads, therefore, provide an electrical insulating as well as a mechanical supporting function. In addition, it will be noted from an inspection of FIGS. 1 and 2 that a similar arrangement of straps is provided for each of the electrode elements of the three guns. By virtue of this mounting arrangement there is a suspension of all four electrodes of each of the three guns. Each one of the electrode elements is independently suspended by a separate strap provided for it. The center gun is provided with two sets of straps on opposite sides thereof so as to be attached to all four of the beads. Because of the electron characteristics of the in-line gun assembly an exact registration between the center and outer guns is required. In the in-line assembly the center gun beam may not be adjusted by the convergence assembly and since the two outer guns are referenced to it, it is necessary to put two straps on the center gun so that it cannot be moved. An integral support having a shape similar to that of an H frame is thus what is provided and it will be noted that, if the straps were beaded without the electrodes attached thereto, there would exist a self-supporting structure. Another significant advantage of this arrangement is that the four beads may be applied simultaneously during assembly so as to enhance the accuracy of alignment. Furthermore, since the straps 23, 24 are attached to the inner surface of the electrodes of the outer guns, this structure is adapted to either internal or external holding of the electrodes during assembly in a beading fixture. Prior art assembly methods have been able to utilize only inside holding of the electrode by means of mandrels.

It was mentioned previously that the electrodes 8 of each of the guns are provided with heaters and cathodes which must be electrically connected. Electrical connections for the cathodes and heaters are provided through the metal prongs in the stem 6, and in accordance with another aspect of this invention an improved arrangement is provided whereby connections may be made to *both* the heaters and cathodes before the stem component is assembled to the electron gun battery 2. Each of the supporting rods or glass beads has associated therewith a first L-shaped metal tab shown, for example, at 29 and 30 in FIG. 1 and at 29 and 31 in FIG. 2. One leg of each L-shaped tab is imbedded in the associated glass bead. First and second mounting bars 32 and 34, respectively, are rigidly mechanically connected at each end thereof to the extending legs of each of the L-shaped tabs imbedded in the supporting rods. This may be seen more easily in FIG. 2. The mounting bars 33, 34, which are electrically conductive, are disposed over the electrode 8 of each of the guns, and the heater wires from each electrode are connected to the bars, for example the wires 35–38, as shown in FIGS. 1 and 2. The mounting bars are welded to the tabs at each end to provide a double-ended support, and this arrangement allows for greater inherent precision in locating the heater connections.

A second group of four metal tabs 41-44 are also imbedded in the support rods, 12–15, and have a double function. The first is to provide a mechanical connection between the stem and gun assembly. As shown, for example, in FIG. 2, the leads 45 and 46 from the stem are mechanically attached to the tabs 41 and 43, respectively. The other two tabs 42 and 44 are likewise attached to two leads from the stem 6. There are thus four rigid mechanical connections between four of the stem prongs and the four tabs 41-44 which are imbedded in the support rods 12–14. By virtue of this arrangement, any force imparted to the stem after it is attached to the gun assembly will not be applied to the electrodes 8 in the gun assembly. The tabs also perform an electrical function in that the cathode connections from the guns are made to three of the tabs as shown, for example, by the cathode ribbon 50 extending from the electrode element 8 to tab 42 in FIG. 1. A connecting bar 53 shown in FIG. 1 extends from one of the heater support bars such as bar 33 to the remaining tab so as to make an electrical connection to the heaters.

This arrangement, therefore, provides several advantages. In the first place, the cathode and heater connections may be made before the stem component is attached to the gun battery assembly. This is a distinct improvement over prior art arrangements in that it is easily adaptable to automated assembly techniques. In the prior art gun assembly arrangements, the heater and cathode connections were made directly to the leads on the stem so that the stem had to be first connected to the gun assembly and then the heater and cathode connections made. The heater and cathode wires were difficult to reach after the stem was connected and this arrangement precluded automated manufacture. Automatic stem welding is thus easily accomplished as all remaining welds are accessible to preset tweezers mounted station after station on a turret. A second advantage is that the four point mechanical connection between the stem prongs and the tabs 41–44 results in the electrodes of the guns being isolated from any forces which are applied to the stem. Thus, any forces applied to the stem will not push the individual electrodes out of alignment as often occurred with prior art arrangements wherein mechanical stem connections were made directly to individual electrode elements.

In addition, the filament mounting bar arrangement provides a convenient means of alternatively connecting the filaments in a series or parallel arrangement without any major change in design of the structure or the assembly equipment. In the embodiment illustrated, a parallel arrangement is used. A series arrangement is used by simply clipping the electrical mounting bars at the appropriate places and connecting the filaments in a suitable manner.

Figure 4:
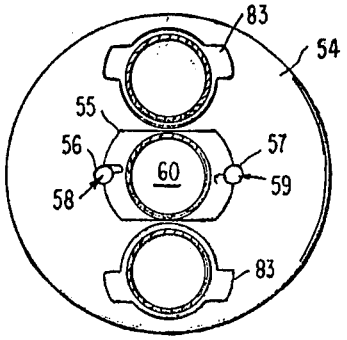
FIG. 4 is a cross sectional view taken along the lines B-B′ in FIG. 1.

Another aspect of this invention is also shown in FIGS. 1 and 2 relating to attachment, with precise alignment accuracy, of the electron guns to the base element 54 of the pole piece convergence assembly 7. Each of the grid elements 11 of the individual electron guns is provided with a flange 55, 83, as shown in FIG. 4, which is usually welded to the base element. Each of the three guns has a corresponding individual aperture in the pole piece assembly. In operation, the three beams travel through the apertures, through individual pairs of pole pieces, or a magnetic shield in the case of the center gun, within the convergence assembly, through apertures in the shadow mask of the tube, and simultaneously land on specific colored dots in a line on the screen. It is thus apparent that a precise degree of alignment accuracy is required in properly mating the convergence assembly to the electron gun structure. In order to register the convergence assembly 7 to the gun battery 2, this invention contemplates the provision of two precision holes 56, 57 in the base element 54 of the convergence assembly as shown in FIG. 4. In addition, two cutouts 58,59 are provided on each side of the flange 55 in the electrode of the center electron gun. These cutouts are accurately located rotationwise during mount beading and provide the reference for $x$ and $y$ and rotational alignment of the gun-to-stem and gun-to-convergence assembly. During assembly, pins are positioned through the holes and the cutouts aligned thereon, and the result is an accurate self-registering convergence assembly alignment in both the rotational and $x$-$y$ directions.

Figure 5:
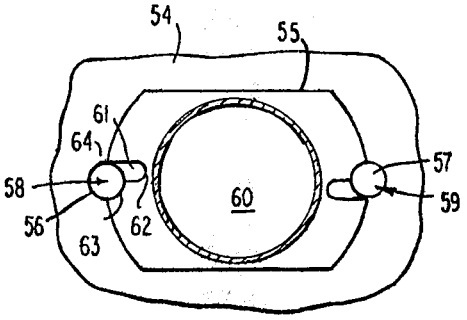
FIG. 5 shows the self registering alignment scheme provided on the center gun in accordance with this invention.

An example of the shape of the cutouts 58, 59 may be more easily seen by referring to FIG. 5 which shows the flange 55 aligned with respect to the holes 56, 57. It was found that when the grid elements were released from a die, the flange thus formed would tend to relieve the stresses created therein by rendering the shape of aperture 60 irregular rather than circular. This would occur when the cutouts 58, 59 were merely semicircular. If the cutouts were enlarged in a direction toward the aperture 60 to relieve the stresses, one degree of freedom would be provided so as to preclude self-registering of the assembly 7 and gun battery 2. Therefore, each of the cutouts is provided with a stress relieving pocket having substantially parallel sides and a shape critical only to an extent as will be explained. Referring to the cutout 58 shown in FIG. 5, there is included a stress-relieving pocket 61. The sides of the pocket may be substantially parallel and the only constraint on the shape of the pocket is that it be such that the distance from the end 62 of the pocket nearest the perimeter of the aperture 60 will be equal to the minimum distance from the aperture perimeter to the edge of the flange 55. The cutout 58 also includes a partially circular portion 63 which describes an arc of approximately 60 degrees. An outer end 64 of the pocket meets the perimeter of the aperture 58 in a point contact. The cutout 59 also has a stress-relieving pocket and both are identical to those just described.

Figure 6:
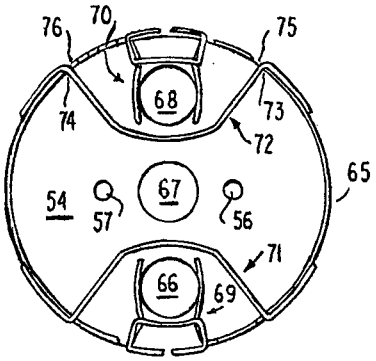
FIG. 6 is a cross sectional view taken along the lines C-C′ of FIG. 1.

The pole piece convergence assembly 7 adapted for use in the electron gun of this invention may be seen more readily in FIG. 6. It is basically an open-ended cylinder having a wall 65 and base element 54. Three apertures, 66–68 are provided in the base element 54 and are accurately aligned with the apertures of the focusing grids of the electron guns as was previously explained. Associated with the outer apertures are what are designated in the art as the x pole pices 69, 70 and the y pole pieces 71, 72. Accurate alignment of the $x$ and $y$ pole pieces with a precise distance therebetween is necessary so that the deflection centers of the electron beams will not shift. A self-registering assembly arrangement is therefore contemplated by this invention. A plurality of slots are provided in the wall of the convergence assembly and may be readily seen by viewing FIG. 2 in conjunction with FIG. 6. For purposes of definition the inside edge of each slot is that edge which the pole piece presses against and the bottom of the slot is likewise that portion against which the pole piece presses. The inside edge and the bottom of each slot are the control dimensions for the self-registering arrangement. Tolerance is therefore allowed in the opposite side of the slot and in the height of the slot. As shown in FIG. 6, *y* pole piece 71 rests against the edges 73, 74 of slots 75, 76, respectively, and against the bottoms 77, 78 of these slots are shown in FIG. 2. Similarly, *x* pole piece 70 rests against inside edges 79, 80 and bottoms 81, 82 of slots 83 and 84, respectively, as shown in FIG. 2. The outer *y* pole pieces are similarly positioned, i.e., forced against the outer edges of the slots. The center gun is magnetically isolated by a shield cut to a length to equalize rastor sizes. By virtue of this arrangement, no jigging by means of additional equipment is necessary as the construction of the pole piece provides its own jigging.

The mounting straps 17 as shown in the drawing are of the "wrap-around" type familiar in the art. It will be appreciated that other mount arrangements may be utilized. For example, most of the wrap-around portion of straps might be eliminated thus leaving "L" shaped mounting legs with a short foot portion welded to the electrode and the other end of the elongated portion imbedded into the support rods. Conventional "U" shaped mounting straps might also be used with the bottom of the "U" being welded to the electrode. In any case, it is important that the center gun be mounted from all four support rods for rigidity and to provide the desired integral structure.

In some situations, it may be desired to shield the exit fields of the convergence assembly from the entrance field of the deflection yoke to prevent undesired interaction. This may be accomplished by welding a flat eddy current shield piece (not shown) on the outer edge 91 of the convergence assembly. To facilitate the welding, one or more cutouts 90 are provided close to the edge 91 into which the welding electrode may be conveniently placed.

From the foregoing, it may be seen that the electron gun arrangement herein described accomplishes the objects of this invention. The mounting means 16 comprising the straps 23, 24 connecting each of the outer guns to the beads 13, 14 and 12, 15 and the straps 17, 20 connecting the center gun to all four beads provides an integral structure which maintains a rigid alignment between the center and the two outer electron guns. The mounting bars 33, 34 attached at both ends to the one group of four L-shaped tabs imbedded in the beads permit the heater electrical connections to be made before the stem is attached and thus makes the assembly adaptable to automated methods. The mechanical connection of the four stem leads to the four additional "U" shaped tabs imbedded in the beads isolates the grid elements of the electron guns from any mechanical forces applied to the stem. The precision holes provided in the base of the convergence assembly and the cutouts provided in the flange of the grid element of the center gun permit a self-registering alignment between the gun battery and convergence assembly which prevents both rotational and linear misalignment errors. They are also useful in providing alignment indices for mounting the stem accurately to the gun assembly. This is important since mounting of the completed gun into the neck of the tube relies on positioning of the stem for alignment, rotational as well as linear, since there is no way to check physically the gun alignment once the gun assembly is inside the tube neck. The utilization of control dimensions comprising the edges and bottoms of slots provided in the convergence assembly permits a self-registering alignment among the pole pieces included within the convergence assembly.

One particular advantage of this construction in which the outer guns are rigidly aligned with the center gun to form an integral assembly at the time the support rods are beaded onto the electrode straps, the supports being the means by which the stem assembly is structurally mounted to the gun assembly independent of the gun electrodes, is that any errors that might occur in physical alignment of the gun are inevitably limited to a single point in the assembly procedure, namely the initial point at which all mounting straps are beaded to the support rods. This is because, with such an integral, rigid structure further handling of the assembly is not likely to cause the guns or the electrodes thereof to come out of alignment. Moreover, since the entire philosophy of this design is to mount and align everything with respect to the center gun, the precision of alignment of the convergence cup and stem to the guns, and the ultimate alignment of the complete gun assembly in the tube is achieved more readily thus materially reducing the number of rejects based on this problem in a commercial tube manufacturing operation.

While the invention has been described with specificity, it is the aim of the appended claims to cover all such variations as come within the true spirit and scope of the foregoing disclosure.

What is claimed is:

1. In combination with three electron guns disposed such that the axes of said guns lie in the same plane:

I. four support rods positioned around said guns in a spaced relationship;

II. mounting strap means for connecting the center one of said three guns to all four of said support rods, and each of the outer two of said three guns to only two of said four support rods, said mounting strap means comprising a. a first mounting strap arrangement rigidly attached to the center gun on one side of said plane and having corresponding ends secured to a first pair of said support rods located on the same side of said plane;

b. a second mounting strap arrangement rigidly attached to the center gun on the opposite side of said plane from the first strap arrangement and having corresponding ends secured to a second pair of said support rods located on said opposite side of said plane;

c. a third mounting strap arrangement rigidly attached to one of the two outer guns and having an end thereof located on the one side of said plane and secured to one of the rods from said first pair and another end thereof located on the other side of said plane and secured to one of the rods of said second pair; and d. a fourth mounting strap arrangement rigidly attached to the other one of the two outer guns and having an end thereof located on the one side of said plane and secured to the other rod of said first pair and another end thereof located on the other side of said plane and secured to the other rod of said second pair.

2. In combination with a central electron gun and two outer electron guns in the neck of a cathode ray tube, said guns being disposed such that their longitudinal axes lie in a common plane, support means for said guns contained within said neck, said support means comprising:

four support rods positioned in a spaced relationship around said guns, first and second ones of said rods being spaced on one side of said plane and third and fourth ones of said rods being spaced on the other side of said plane; and mounting strap means joined to said central electron gun and forming a rigid truss type structure including first and second mounting straps such that said gun constitutes the intersection of first, second, third and fourth truss members extending from said first, second, third and fourth support rods, respectively, said first mounting strap extending between said first and third rods so as to constitute a fifth truss member and said second mounting strap extending between said second and fourth rods so as to constitute a sixth truss member, said first and second mounting straps each intersecting said plane, each of said outer electron guns being rigidly connected to said first and second mounting straps constituting said fifth and sixth members, respectively.

3. The apparatus of claim 2 wherein said support rods are mounted substantially equidistantly from said central gun.

4. The apparatus of claim 3 wherein said support rods are mounted substantially equidistantly from said common plane.

5. In combination with a central electron gun and two outer electron guns in the neck of a cathode ray tube, said guns being disposed such that their longitudinal axes lie in a common plane, support means for said guns occupying a minimum amount of cross sectional area within said neck, said support means comprising:

four support rods positioned in a spaced relationship around said guns, first and second ones of said rods being spaced on one side of said plane and third and fourth ones of said rods being spaced on the other side of said plane, each of said rods being spaced substantially equidistantly from the longitudinal axis of said central electron gun at a distance no greater than substantially the distance from the axis of said central gun to the outermost surface of either of said outer electron guns; and mounting strap means rigidly connecting said central electron gun to all of said four support rods, one of said outer electron guns to said first and third support rods, and the other of said outer electron guns to said second and fourth support rods, said mounting strap means being affixed to said central gun along a pair of diametrically opposed surface portions thereof and being affixed to each of said outer guns along a single surface portion thereof, respectively.

6. The apparatus of claim 5 wherein each one of said pair of diametrically opposed surface portions is situated on a separate side, respectively, of said common plane and wherein said single surface portion of each of said outer guns, respectively, intersects said common plane.

7. The apparatus of claim 5 wherein said single surface portion of each of said outer guns, respectively, faces toward said central gun.

* * * * *